US011044550B2

(12) United States Patent
Hsu et al.

(10) Patent No.: US 11,044,550 B2
(45) Date of Patent: Jun. 22, 2021

(54) SPEAKER DEVICE HAVING A MONOLITHIC ONE-PIECE VIBRATION DAMPING STRUCTURE

(71) Applicant: Vanson Electronics (Nanhai) Co., Ltd., Foshan (CN)

(72) Inventors: Ching-Shan Hsu, Taipei (TW); Hao-Chien Hsu, Taipei (TW)

(73) Assignee: Vanson Electronics (Nanhai) Co., Ltd., Foshan (CN)

( * ) Notice: Subject to any disclaimer, the term of this patent is extended or adjusted under 35 U.S.C. 154(b) by 0 days.

(21) Appl. No.: 16/551,746

(22) Filed: Aug. 27, 2019

(65) Prior Publication Data

US 2020/0329302 A1 Oct. 15, 2020

(30) Foreign Application Priority Data

Apr. 13, 2019 (CN) ..... 201910296448.5

(51) Int. Cl.
*H04R 1/28* (2006.01)
*H04R 1/02* (2006.01)

(52) U.S. Cl.
CPC ..... *H04R 1/288* (2013.01); *H04R 1/023* (2013.01)

(58) Field of Classification Search
CPC ... H04R 7/26; H04R 9/06; H04R 9/02; H05K 7/142
See application file for complete search history.

(56) References Cited

U.S. PATENT DOCUMENTS 5,550,712 A * 8/1996 Crockett ..... H05K 7/142 174/564
9,548,144 B2 * 1/2017 Blazic ..... H05K 5/0073
2002/0051338 A1 * 5/2002 Jiang ..... G11B 33/14 361/679.36
2008/0316698 A1 * 12/2008 Yeh ..... G11B 33/08 361/679.33
2010/0160006 A1 * 6/2010 Wu ..... H04M 1/0264 455/575.1
2014/0139979 A1 * 5/2014 Blazic ..... H05K 7/02 361/679.01
2015/0245122 A1 * 8/2015 Rayner ..... H04R 1/2896 381/152
2019/0182582 A1 * 6/2019 Huang ..... H04R 1/025

FOREIGN PATENT DOCUMENTS

JP 2014154922 A * 8/2014

OTHER PUBLICATIONS

Tech Products, Vibration and Shock Isolation Products, 2017, p. 52 (Year: 2017).*

* cited by examiner

*Primary Examiner* — Fan S Tsang
*Assistant Examiner* — Angelica M McKinney
(74) *Attorney, Agent, or Firm* — Winston Hsu

(57) ABSTRACT

A speaker device including a first speaker cover, a second speaker cover, a speaker housed by the first speaker cover and the second speaker cover, and a monolithic, one-piece vibration damping structure disposed between the first speaker cover and the second speaker cover. The first speaker cover and the second speaker cover are made of a first material, and the monolithic, one-piece vibration damping structure is made of a second material that is different from the first material.

19 Claims, 7 Drawing Sheets

SPEAKER DEVICE HAVING A MONOLITHIC ONE-PIECE VIBRATION DAMPING STRUCTURE

BACKGROUND OF THE INVENTION

1. Field of the Invention

The present disclosure relates to the technical field of speaker devices. More particularly, the present disclosure relates to a monolithic, one-piece vibration damping structure for speaker devices.

2. Description of the Prior Art

With the rapid development of speakers, the demand for high-quality sound at consumer end increases. It is known that the speaker devices when assembled in the electronic devices such as laptops or tablets may resonate and may generate vibration energy, which are problematic and undesirable. The vibration of the speaker device mounted in an electronic device not only produces audible noise, but propagates along the mechanical parts of the electronic device, which may cause degradation of device performance or device failure.

FIG. 1 is a schematic diagram showing a prior art speaker device. FIG. 2 is an exploded view of the speaker device in FIG. 1. Conventionally, as shown in FIG. 1 and FIG. 2, to reduce the resonation or vibration originated from the speaker device 1 within an electronic device such as a laptop (not shown), a vibration damping structure 10 is used. The conventional vibration damping structure 10 is composed of a plastic ear portion 11 integrally protruding from a sidewall of the body of the speaker cover 2 or 4, which houses the speaker 3. A rubber cushion 12 is inserted into a through hole 11*a* of the rigid ear portion 11, and then the ear portion 11 and the rubber cushion 12 are secured to corresponding positioning members 50 on the support plate 5 by screws 13. The rubber cushion 12 may have various sectional shapes such as I-shape or the gourd shape, or the like.

However, since the plastic ear portion 11 is rigid, the vibration absorption of the conventional vibration damping structure 10 is not satisfactory. In particular, the vibration damping structure 10 used in the traditional speaker devices relies on the combination of the rigid ear portion 11 and the rubber cushion 12, therefore, the effective vibration absorption area is relatively small. It is difficult to absorb the vibration, not to mention eliminating or reducing the adverse consequences of the vibration. In light of the above, there is a strong need in this industry to provide a high-efficient, high-performance vibration damping structure to solve the above problems.

SUMMARY OF THE INVENTION

In view of the deficiencies of the prior art, it is an object of the present invention to provide an improved vibration damping structure to solve the above problems in the background art.

To achieve the above object, the present invention provides the following technical solutions.

One aspect of the present disclosure provides a speaker device including a first speaker cover, a second speaker cover, a speaker housed by the first speaker cover and the second speaker cover, and a monolithic, one-piece vibration damping structure disposed between the first speaker cover and the second speaker cover.

According to some embodiments, the first speaker cover and the second speaker cover are made of a first material, and the monolithic, one-piece vibration damping structure is made of a second material that is different from the first material.

According to some embodiments, the first speaker cover and the second speaker cover are made of polycarbonate (PC) or acrylonitrile-butadiene-styrene copolymer (ABS).

According to some embodiments, the monolithic, one-piece vibration damping structure is made of rubber, silica gel, foam, or any combinations thereof.

According to some embodiments, the monolithic, one-piece vibration damping structure comprises a middle connecting portion.

According to some embodiments, the middle connecting portion is made of a vibration-absorbing material.

According to some embodiments, the vibration-absorbing material comprises rubber, silica gel, foam, or any combinations thereof.

According to some embodiments, the middle connecting portion has a top surface and a bottom surface, and wherein the top surface is in direct contact with the first speaker cover, and the bottom surface is in direct contact with the second speaker cover.

According to some embodiments, the monolithic, one-piece vibration damping structure comprises an upper vibration-absorption ring disposed on the top surface and a lower vibration-absorption ring disposed on bottom surface, and wherein the upper vibration-absorption ring and the lower vibration-absorption ring are integrally formed with the middle connecting portion.

According to some embodiments, the upper vibration-absorption ring and the lower vibration-absorption ring are made of a vibration-absorbing material.

According to some embodiments, the vibration-absorbing material comprises rubber, silica gel, foam, or any combinations thereof.

According to some embodiments, the middle connecting portion has a through hole that is aligned with the upper vibration-absorption ring and the lower vibration-absorption ring.

According to some embodiments, the through hole has a diameter that is smaller than that of the upper vibration-absorption ring and the lower vibration-absorption ring.

According to some embodiments, the middle connecting portion comprises assembly holes that penetrate through an entire thickness of the middle connecting portion.

According to some embodiments, the multiple assembly holes are disposed on a fringe portion of the multiple assembly holes.

According to some embodiments, the fringe portion is mounted on corresponding assembly poles provided within a mounting region of the second speaker cover.

According to some embodiments, the monolithic, one-piece vibration damping structure is secured to corresponding positioning members on a support plate by screws.

According to some embodiments, the monolithic, one-piece vibration damping structure is adhered to the first speaker cover or the second speaker cover.

According to some embodiments, the monolithic, one-piece vibration damping structure and the first speaker cover or the second speaker cover are a two-shot injection molded integral structure.

According to some embodiments, the monolithic, one-piece vibration damping structure and the first speaker cover or the second speaker cover ultrasonically welded into a unitary structure.

In summary, the present disclosure has the following beneficial effects compared with the prior art.

The traditional rigid ear bracket is replaced with the monolithic, one-piece vibration damping structure, so that the effective area of vibration absorption is increased, which can better absorb the vibration energy, and eliminate or mitigate the vibration or resonation. As a result, the resonance problem of the prior art vibration damping mechanism can be well solved, the failure rate is greatly reduced, the product quality is improved, and the new market demand is better met.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the disclosure, reference is made to the accompanying drawings, which form a part hereof, and in which is shown, by way of illustration, specific embodiments in which the invention may be practiced. These embodiments are described in sufficient detail to enable those skilled in the art to practice the invention.

Other embodiments may be utilized, and structural, logical, or electrical changes may be made without departing from the scope of the present invention. Therefore, the following detailed description is not to be considered as limiting, but the embodiments included herein are defined by the scope of the accompanying claims.

The present disclosure pertains to an improved vibration damping structure for speaker devices that may be installed in an electronic device such as a laptop or a tablet. According to one embodiment, the improved vibration damping structure is made of monolithic, one-piece rubber. By using such one-piece vibration damping structure, the audible noise, vibration, and the resonation produced by the speaker devices can be significant reduced.

Figure 3:
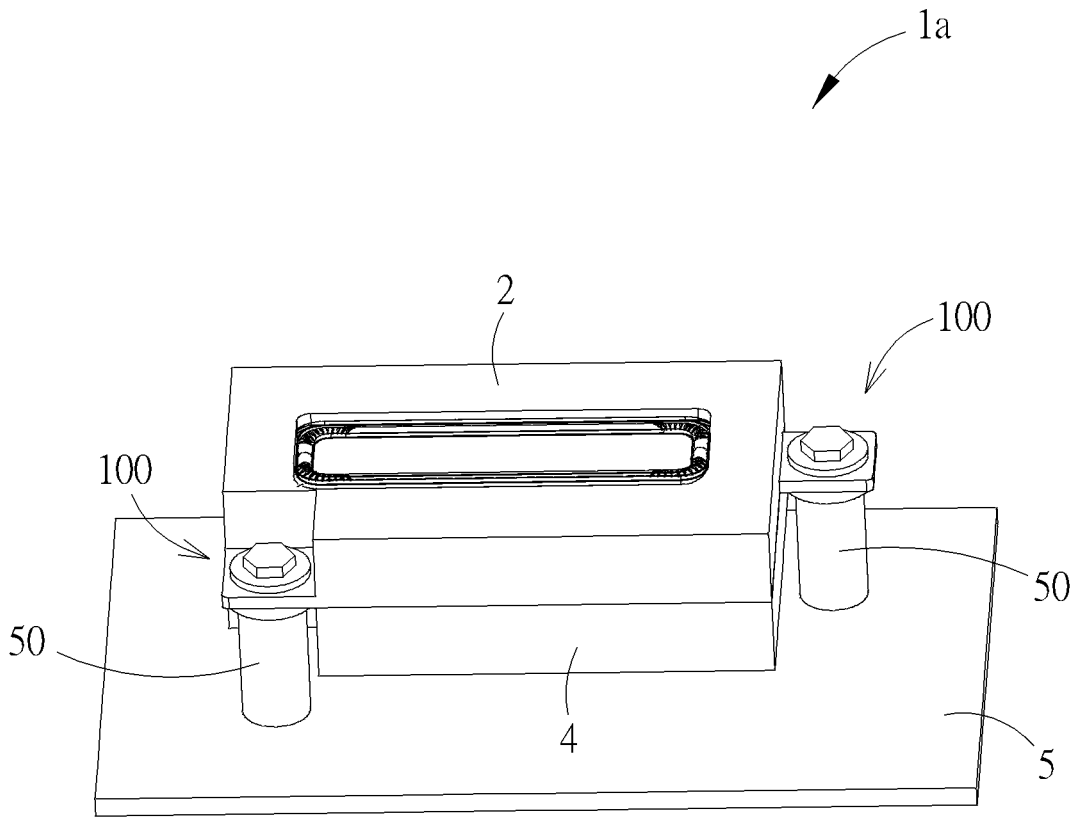
FIG. 3 is a schematic diagram showing a speaker device according to one embodiment.
Figure 4:
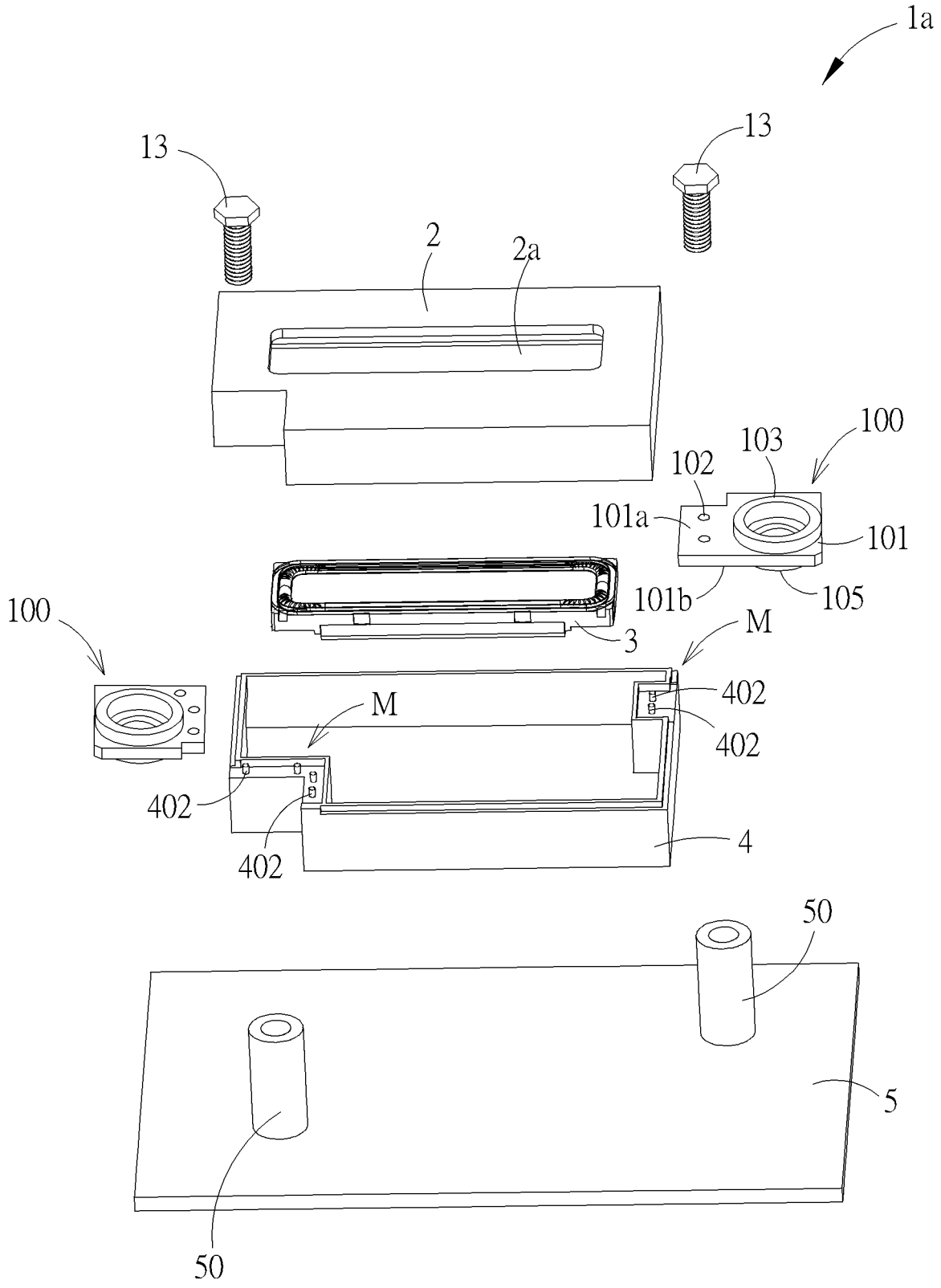
FIG. 4 is an exploded view of the speaker device in FIG. 3.
Figure 5:
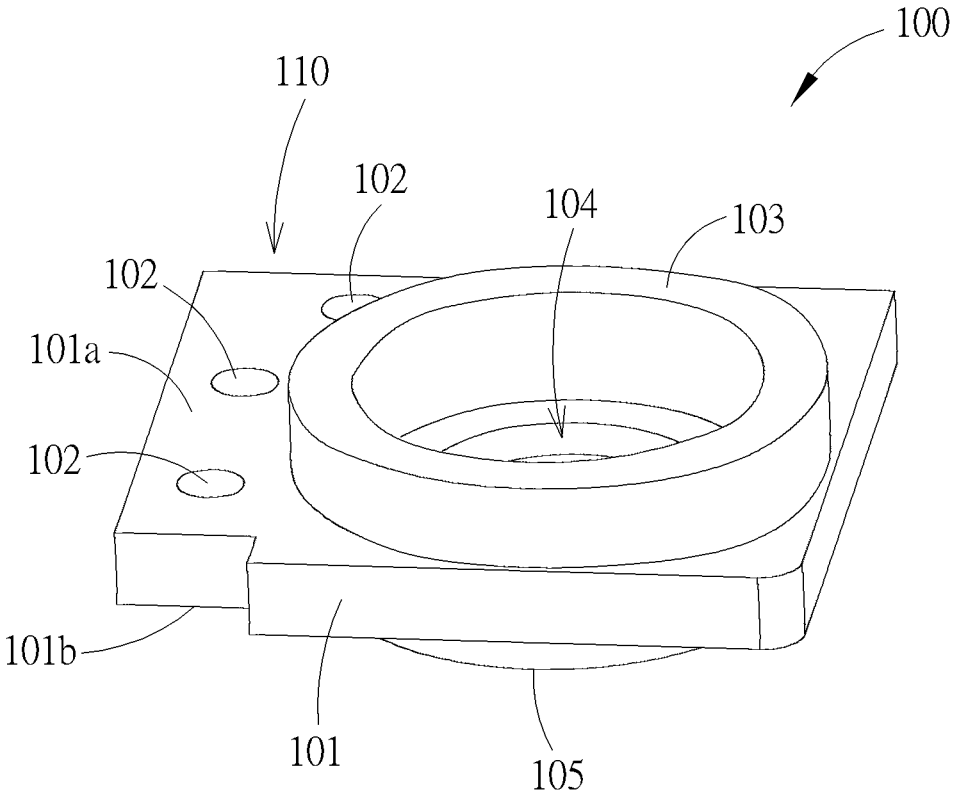
FIG. 5 is an enlarged view showing the monolithic, one-piece vibration damping structure in FIG. 4.

Please refer to FIG. 3 to FIG. 5. FIG. 3 is a schematic diagram showing a speaker device according to one embodiment of the present disclosure. FIG. 4 is an exploded view of the speaker device in FIG. 3. FIG. 5 is an enlarged view showing the monolithic, one-piece vibration damping structure in FIG. 4. As shown in FIG. 3 and FIG. 4, the speaker device 1*a* comprises a first speaker cover 2, a second speaker cover 4, and a speaker 3 housed by the first speaker cover 2 and the second speaker cover 4. According to one embodiment, an aperture 2*a* may be provided on the first speaker cover 2. The aperture 2*a* may be aligned with the speaker 3. According to a non-limiting embodiment, for example, the speaker 3 may be mounted onto an interior surface of the first speaker cover 2.

According to one embodiment, two monolithic, one-piece vibration damping structures 100 are disposed between the first speaker cover 2 and the second speaker cover 4. According to one embodiment, the two vibration damping structures 100 may be disposed along two opposite sides of the speaker device 1*a*, respectively. It is to be understood that the shapes, sizes, location and configuration of each part of the speaker device 1*a* are for illustration purposes only. In some embodiments, the two vibration damping structures 100 may have the same structure or shape depending upon design requirements.

According to one embodiment, the first speaker cover 2 and the second speaker cover 4 are made of a first material, and the monolithic, the one-piece vibration damping structure 100 is made of a second material that is different from the first material. According to one embodiment, the first speaker cover 2 and the second speaker cover 4 may be made of plastic materials such as polycarbonate (PC) or acrylonitrile-butadiene-styrene copolymer (ABS), but is not limited thereto. According to one embodiment, each of the two vibration damping structures 100 may be made of a vibration-absorbing material such as rubber, silica gel, foam, or any combinations thereof, but is not limited thereto. For example, According to one embodiment, each of two vibration damping structures 100 may be made of monolithic, one-piece rubber, but is not limited thereto.

As shown in FIG. 4 and FIG. 5, each of two vibration damping structures 100 may comprise a middle connecting portion 101. According to one embodiment, the middle connecting portion 101 may have an approximately rectangular shape. According to one embodiment, the middle connecting portion 101 may be made of a vibration-absorbing material such as rubber, silica gel, foam, or any combinations thereof, but is not limited thereto. For example, the middle connecting portion 101 may be a rubber pad. The middle connecting portion 101 has a top surface 101*a* and a bottom surface 101*b*. The top surface 101*a* is in direct contact with the first speaker cover 2, and the bottom surface 101*b* is in direct contact with the second speaker cover 4.

According to one embodiment, the middle connecting portion 101 may comprise multiple assembly holes 102 that penetrate through the entire thickness of the middle connecting portion 101. The multiple assembly holes 102 may be disposed on a fringe portion 110 of the multiple assembly holes 102. According to one embodiment, only the fringe portion 110 of the multiple assembly holes 102 is interposed and clamped between the first speaker cover 2 and the second speaker cover 4. The fringe portion 110 of the multiple assembly holes 102 is mounted on the corresponding assembly poles 402 provided within a mounting region M of the second speaker cover 4. The assembly poles 402 penetrate through the assembly holes 102, respectively.

Optionally, glue or adhesive may be applied between the assembly holes 102 and the assembly poles 402. Optionally, glue or adhesive may be applied between the top surface 101*a* and the first speaker cover 2. Optionally, glue or adhesive may be applied between the bottom surface 101*b* and the second speaker cover 4.

According to one embodiment, each of two vibration damping structures 100 may further comprise an upper vibration-absorption ring 103 and a lower vibration-absorption ring 105, which are integrally formed with the middle connecting portion 101. According to one embodiment, the upper vibration-absorption ring 103 and the lower vibration-absorption ring 105 may be made of a vibration-absorbing material such as rubber, silica gel, foam, or any combinations thereof, but is not limited thereto. For example, the upper vibration-absorption ring 103 and the lower vibration-absorption ring 105 may be rubber rings. The middle connecting portion 101 has a through hole 104 that is aligned with the upper vibration-absorption ring 103 and the lower vibration-absorption ring 105. According to one embodiment, the through hole 104 may have a diameter that is smaller than that of the upper vibration-absorption ring 103 and the lower vibration-absorption ring 105.

The upper vibration-absorption ring 103 and the lower vibration-absorption ring 105 may have the same dimension or diameter. However, it is understood that the upper vibration-absorption ring 103 and the lower vibration-absorption ring 105 may different same dimensions or diameters.

As shown in FIG. 3, according to one embodiment, the two vibration damping structures 100 may be secured to corresponding positioning members 50 on the support plate 5 by screws 13 or any equivalent means. For example, in some embodiments, the positioning member 50 may be used along instead of the screw 13. One end of the positioning member 50 may have a snap mechanism such that the end of the positioning member 50 can interlock with the upper vibration-absorption ring 103. Optionally, the middle connecting portion 101 can be adhered to the first speaker cover 2 or the second speaker cover 4 and then assembled in one piece.

Figure 1:
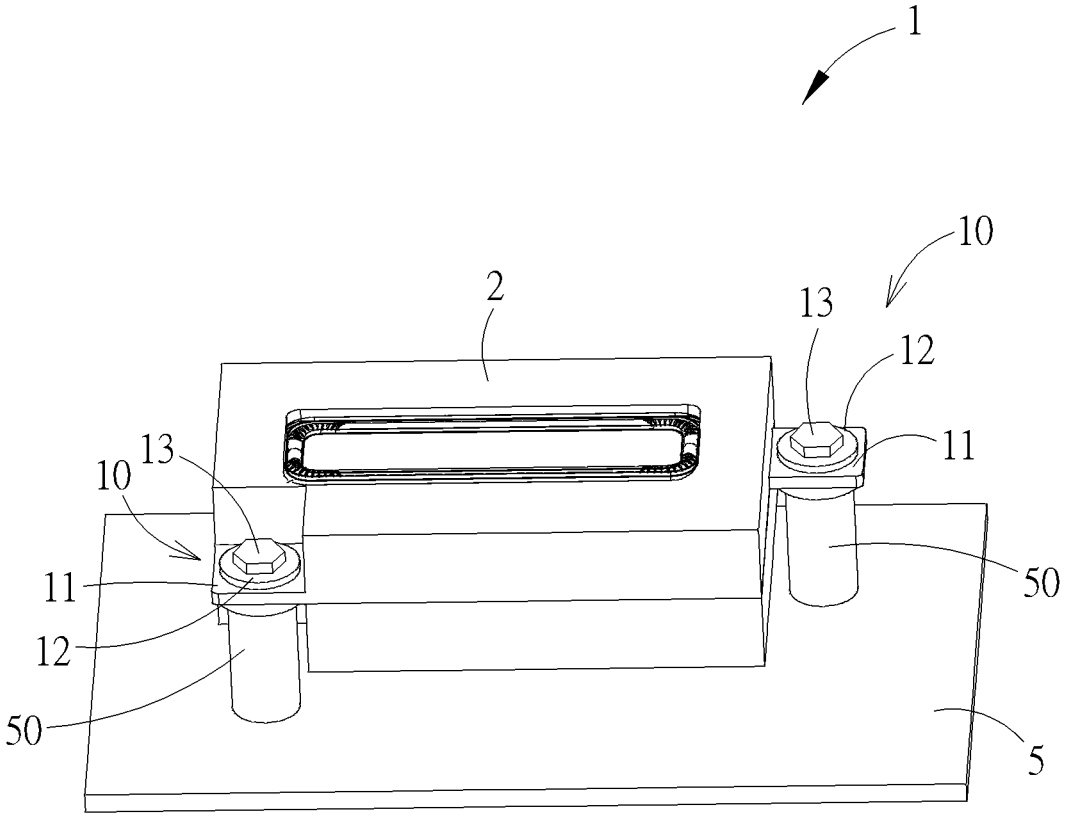
FIG. 1 PRIOR ART
FIG. 1 is a schematic diagram showing a prior art speaker device.
Figure 2:
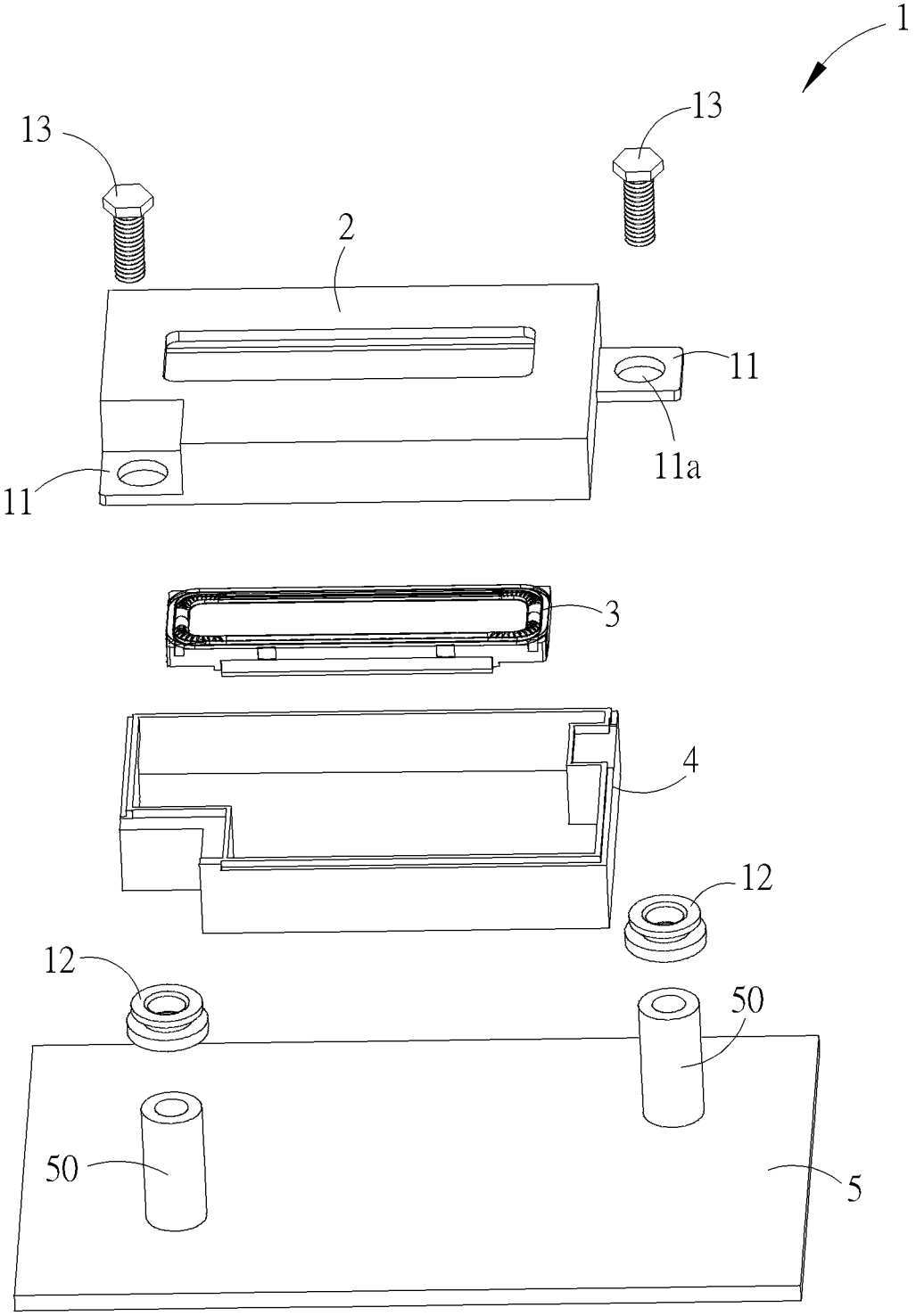
FIG. 2 PRIOR ART
FIG. 2 is an exploded view of the speaker device in FIG. 1.

Compared with the conventional vibration damping structure as depicted in FIG. 1 and FIG. 2, the monolithic, one-piece vibration damping structure 100 of the present disclosure replaces the rigid ABS ear portion 11 and the I-shaped or the gourd-shaped cushion 12 of the conventional two-piece vibration damping structure 10, thereby solving the problematic vibration and/or resonation issues. As previously mentioned, since the plastic ear portion 11 is rigid, the vibration absorption of the conventional vibration damping structure 10 is not satisfactory. In particular, the vibration damping structure 10 used in the traditional speaker devices relies on the combination of the rigid ear portion 11 and the rubber cushion 12, therefore, the effective vibration absorption area is relatively small. It is difficult to absorb the vibration, not to mention eliminating or reducing the adverse consequences of the vibration.

To eliminate or mitigate the adverse consequences of vibration, the monolithic, one-piece vibration damping structure 100 is provided, so that the resonance problem of the speaker damping mechanism can be well solved, the failure rate can be greatly reduced, the product quality is improved, and the new market demand is better met.

According to some embodiments, the vibration damping structures 100 may be integrally disposed on the first speaker cover 2 or the second speaker cover 4 by two-shot injection (double-injection) molding methods or assembly methods.

When the two-shot injection molding method is adopted, the vibration damping structures 100 and the first speaker cover 2 and the second speaker cover 4 are two-shot injection molded thereby forming an integral part. For example, after the first speaker cover 2 or the second speaker cover 4 are injection molded, immediately injection molding the vibration damping structures 100 with the first speaker cover 2 or the second speaker cover 4.

When the assembly method is adopted, the vibration damping structures 100 may be sandwiched by the first speaker cover 2 and the second speaker cover 4, which are then jointed by ultrasonic fusion process thereby forming an integral part to achieve the design purpose.

Further, the speaker 4 may be assembled between the first speaker cover 2 and the second speaker cover 4.

Figure 6:
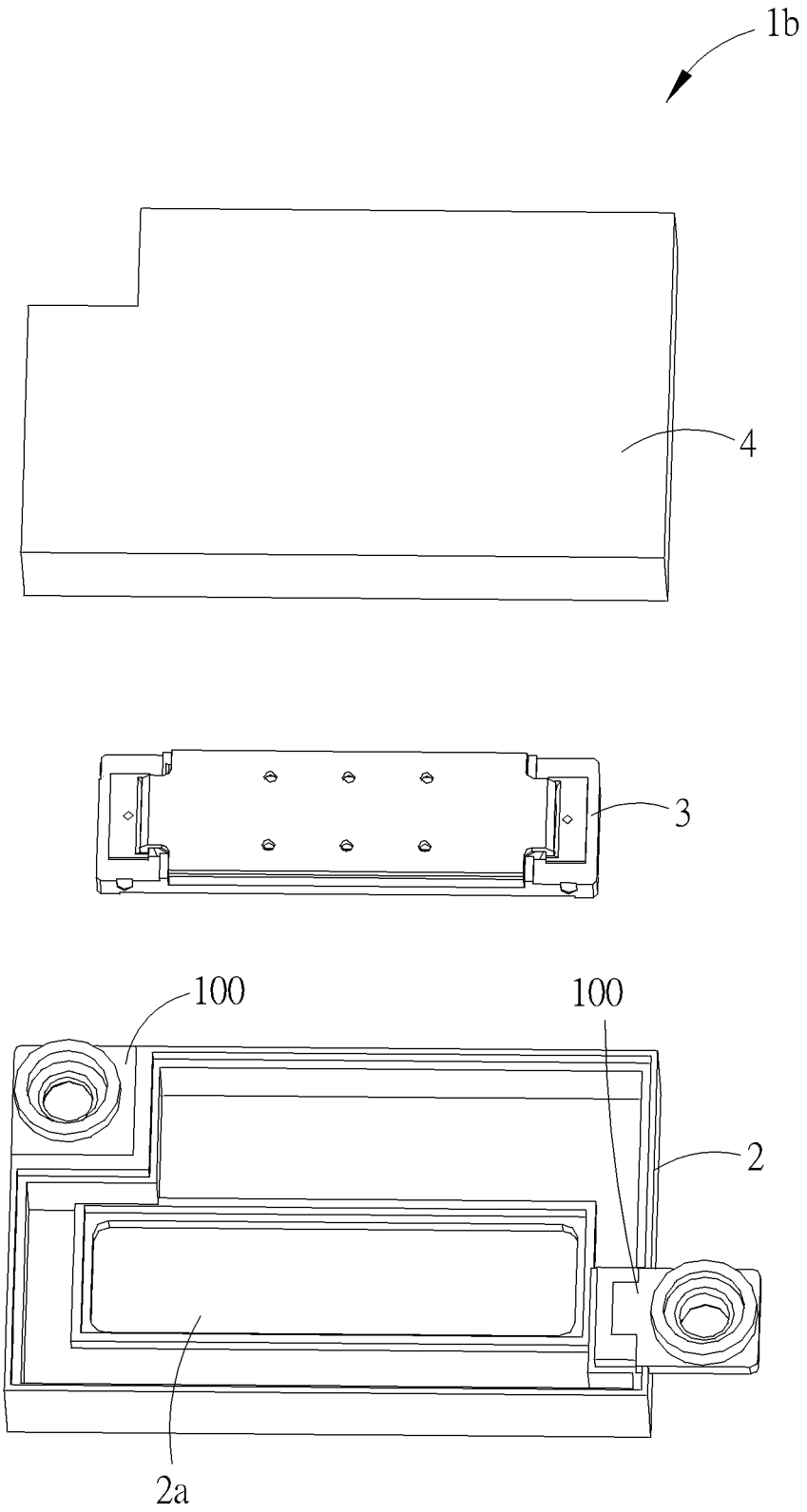
FIG. 6 is a schematic exploded view showing the speaker device according to another embodiment.
Figure 7:
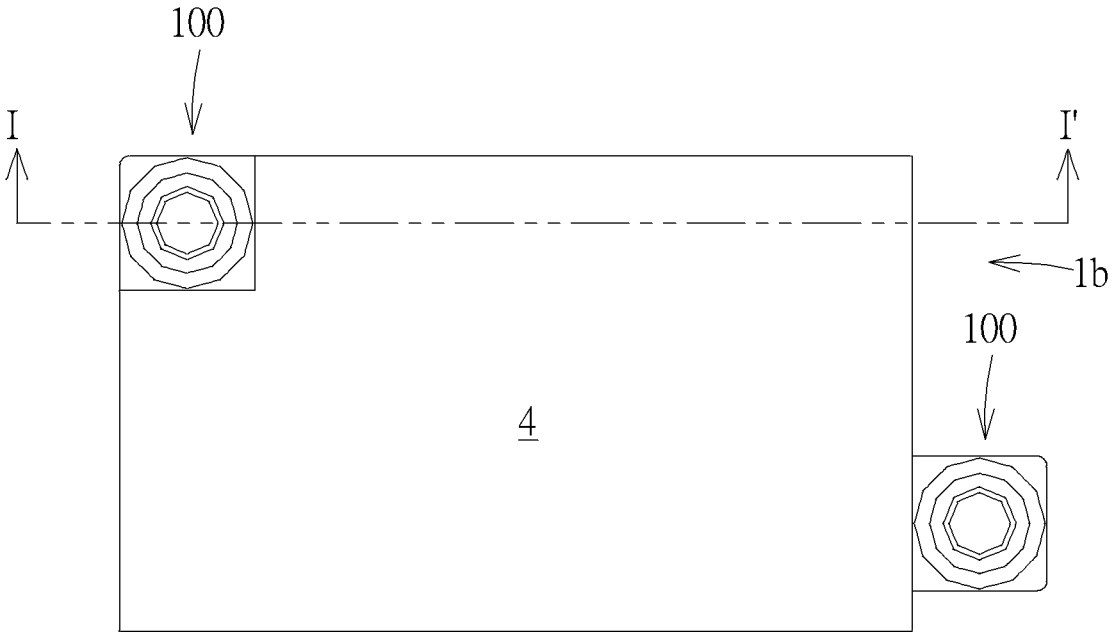
FIG. 7 is a top view of the speaker device.
Figure 8:
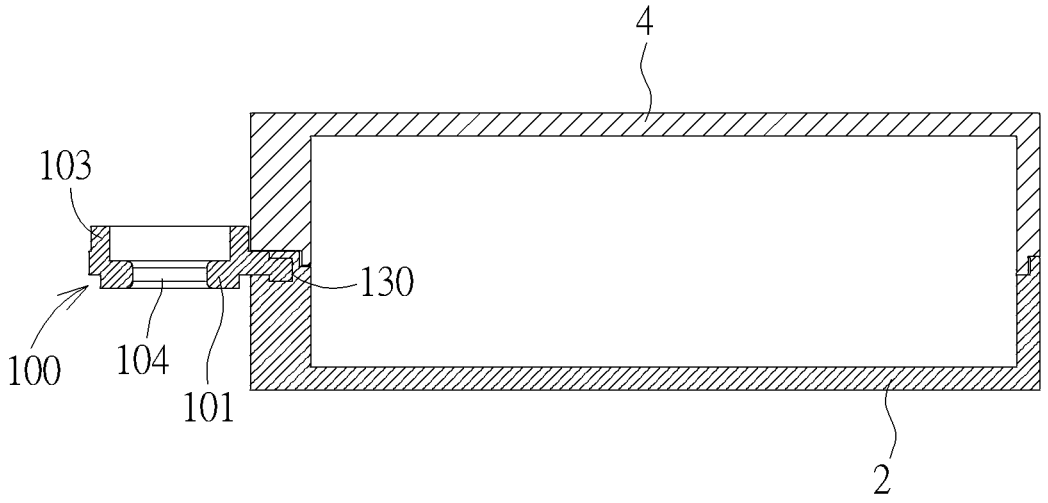
FIG. 8 is a schematic, cross-sectional diagram taken along in FIG. 7.

FIG. 6 is a schematic exploded view showing the speaker device according to another embodiment. FIG. 7 is a top view of the speaker device. FIG. 8 is a schematic, cross-sectional diagram taken along line-I-I' in FIG. 7. Like numeral numbers designate like elements, layers or regions.

As shown in FIG. 6, likewise, the speaker device 1*b* comprises a first speaker cover 2, a second speaker cover 4 and a speaker 3 housed by the first speaker cover 2 and the second speaker cover 4, and vibration damping structures 100 integrally formed on the first speaker cover 2. In some embodiments, the vibration damping structures 100 may be integrally formed on the second speaker cover 4.

For example, the first speaker cover 2 and the vibration damping structures 100 are two-shot injection molded so as to form an integral part, which is then assembled with the second speaker cover 4. That is, the vibration damping structures 100 and the first speaker cover 2 constitute an integral structure because of two-injection molding, and then assembled with second speaker cover 4. In this case, the assembly holes 102 of the vibration damping structures 100 and the assembly poles 402 in FIG. 4 may be omitted.

According some embodiments, the vibration damping structures 100 is two-shot injection molded with the first speaker cover 2 and assembled with the second speaker cover 4;

According some embodiments, the vibration damping structures 100 is two-shot injection molded with the second speaker cover 4, it is assembled with the first speaker cover 2.

Further, the speaker 3 is assembled between the first speaker cover 2 and the second speaker cover 4.

According to one embodiment, the first speaker cover 2 and the second speaker cover 4 may be made of plastic materials such as polycarbonate (PC) or acrylonitrile-butadiene-styrene copolymer (ABS), but is not limited thereto. According to one embodiment, each of the two vibration damping structures 100 may be made of a vibration-absorbing material such as rubber, silica gel, foam, or any combinations thereof, but is not limited thereto.

According some embodiments, as shown in FIG. 7 and FIG. 8, the vibration damping structures 100 may comprise an anchored portion 130 that extends into a sidewall of the first speaker cover 2. Such anchored portion 130 may provide a robust speaker device 1*b*.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A speaker device, comprising:

a first speaker cover;

a second speaker cover;

a speaker housed by the first speaker cover and the second speaker cover; and a monolithic, one-piece vibration damping structure disposed between the first speaker cover and the second speaker cover, wherein the monolithic, one-piece vibration damping structure comprises a middle connecting portion, wherein only the middle connecting portion is overlapped by the first speaker cover and the second speaker cover.

2. The speaker device according to claim 1, wherein the first speaker cover and the second speaker cover are made of a first material, and the monolithic, one-piece vibration damping structure is made of a second material that is different from the first material.

3. The speaker device according to claim 1, wherein the first speaker cover and the second speaker cover are made of polycarbonate (PC) or acrylonitrile-butadiene-styrene copolymer (ABS).

4. The speaker device according to claim 1, wherein the monolithic, one-piece vibration damping structure is made of rubber, silica gel, foam, or any combinations thereof.

5. The speaker device according to claim 1, wherein the middle connecting portion is made of a vibration-absorbing material.

6. The speaker device according to claim 5, wherein the vibration-absorbing material comprises rubber, silica gel, foam, or any combinations thereof.

7. The speaker device according to claim 1, wherein the middle connecting portion has a top surface and a bottom surface, and wherein the top surface is in direct contact with the first speaker cover, and the bottom surface is in direct contact with the second speaker cover.

8. The speaker device according to claim 7, wherein the monolithic, one-piece vibration damping structure comprises an upper vibration-absorption ring disposed on the top surface and a lower vibration-absorption ring disposed on bottom surface, and wherein the upper vibration-absorption ring and the lower vibration-absorption ring are integrally formed with the middle connecting portion.

9. The speaker device according to claim 8, wherein the upper vibration-absorption ring and the lower vibration-absorption ring are made of a vibration-absorbing material.

10. The speaker device according to claim 9, wherein the vibration-absorbing material comprises rubber, silica gel, foam, or any combinations thereof.

11. The speaker device according to claim 8, wherein the middle connecting portion has a through hole that is aligned with the upper vibration-absorption ring and the lower vibration-absorption ring.

12. The speaker device according to claim 11, wherein the through hole has a diameter that is smaller than that of the upper vibration-absorption ring and the lower vibration-absorption ring.

13. The speaker device according to claim 1, wherein the middle connecting portion comprises assembly holes that penetrate through an entire thickness of the middle connecting portion.

14. The speaker device according to claim 13, wherein the multiple assembly holes are disposed on a fringe portion of the multiple assembly holes.

15. The speaker device according to claim 14, wherein the fringe portion is mounted on corresponding assembly poles provided within a mounting region of the second speaker cover.

16. The speaker device according to claim 1, wherein the monolithic, one-piece vibration damping structure is secured to corresponding positioning members on a support plate by screws.

17. The speaker device according to claim 1, wherein the monolithic, one-piece vibration damping structure is adhered to the first speaker cover or the second speaker cover.

18. The speaker device according to claim 1, wherein the monolithic, one-piece vibration damping structure and the first speaker cover or the second speaker cover are a two-shot injection molded integral structure.

19. The speaker device according to claim 1, wherein the monolithic, one-piece vibration damping structure and the first speaker cover and the second speaker cover are ultrasonically welded into a unitary structure.

* * * * *